US010828915B2

(12) United States Patent
Montag

(10) Patent No.: US 10,828,915 B2
(45) Date of Patent: Nov. 10, 2020

(54) TRANSPORTER AND METHOD FOR TRANSPORTING RECORDING MEDIA

(71) Applicant: Océ Holding B.V., Venlo (NL)

(72) Inventor: Thomas Montag, Unterhaching (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/529,344

(22) Filed: Aug. 1, 2019

(65) Prior Publication Data

US 2020/0039247 A1 Feb. 6, 2020

(30) Foreign Application Priority Data

Aug. 3, 2018 (DE) ..... 10 2018 118 900

(51) Int. Cl.
*B41J 11/00* (2006.01)
*B41J 13/00* (2006.01)

(52) U.S. Cl.
CPC ..... *B41J 11/007* (2013.01); *B41J 13/0009* (2013.01)

(58) Field of Classification Search
CPC .... B41J 11/007; B41J 13/0009; B41J 11/0085
See application file for complete search history.

(56) References Cited

U.S. PATENT DOCUMENTS

2002/0067403 A1* 6/2002 Smith ..... B41J 11/0085 347/104
2016/0257142 A1* 9/2016 Soda ..... B41J 2/1714

FOREIGN PATENT DOCUMENTS

JP H09216750 A 8/1997
JP 2011131548 A 7/2011

OTHER PUBLICATIONS

German Search Report dated Jan. 14, 2019, Application No. 10 2018 118 900.1.

* cited by examiner

*Primary Examiner* — Henok D Legesse
(74) *Attorney, Agent, or Firm* — Schiff Hardin LLP

(57) ABSTRACT

A transporter can transports a recording medium on a transport belt through a print group with at least one print head. The transport belt has a plurality of holes via which a negative pressure may be produced to draw/hold a recording medium onto the transport belt. To avoid an air flow below the print head, a decoupler can selectively cover, seal, and/or decouple a source of the negative pressure such that no negative pressure is produced through the holes that are located below the print head and that are not covered by a recording medium.

14 Claims, 5 Drawing Sheets

TRANSPORTER AND METHOD FOR TRANSPORTING RECORDING MEDIA

CROSS REFERENCE TO RELATED APPLICATIONS

This patent application claims priority to German Patent Application No. 102018118900.1, filed Aug. 3, 2018, which is incorporated herein by reference in its entirety.

BACKGROUND

Field

The disclosure relates to a transporter that is configured to direct a recording medium to be printed to through a print group of a printer (e.g. an inkjet printer). The recording medium may be in the form of a sheet, page, or plate, but is not limited thereto.

Related Art

An inkjet printer typically includes a print group having one or more print bars for different inks. A print bar may thereby have one or more print heads having respectively one or more nozzles. For printing to a recording medium, the recording medium may be directed by a transporter past a print head in order to print the dots of different lines of a print image bit by bit onto the recording medium.

The transporter may have a transport belt with a plurality of gaps or holes, via which a negative pressure may be produced in order to hold a recording medium on the transport belt. The negative pressure may be produced by a negative pressure pump.

Directly adjacent recording media in the form of sheets or pages or plates may be conveyed, with a specific distance from one another, on the transport belt so that gaps arise between the recording media, in which gaps the holes of the transport belt are not covered by a recording medium. Relatively high air flows may be produced in these holes by the negative pressure pump. Such an air flow between adjacent recording media may lead to a deflection of ink droplets, and therefore to inaccuracies in the positioning of dots of a print image on the recording media. Furthermore, such air flows increase the air consumption and therefore the power consumption and the requirements for a negative pressure pump. The air flow may also lead to the situation that ink at or in the nozzles of a print head is dried and/or is possibly sucked out of the nozzles, and therefore the print quality of the printer is negatively affected.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
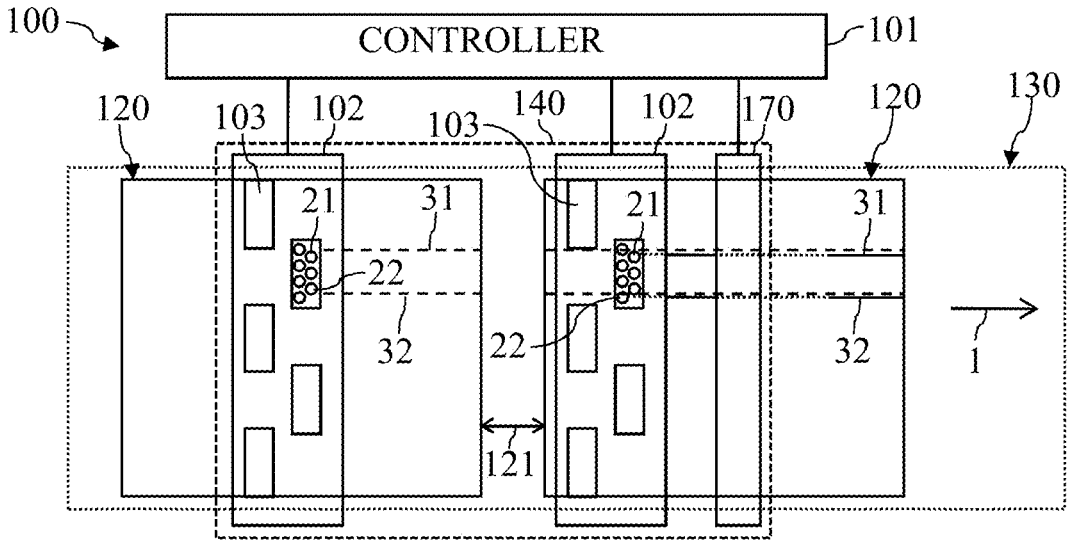

FIG. 1*a* illustrates a block diagram of an inkjet printer according to an exemplary embodiment of the present disclosure.

Figure 1B:
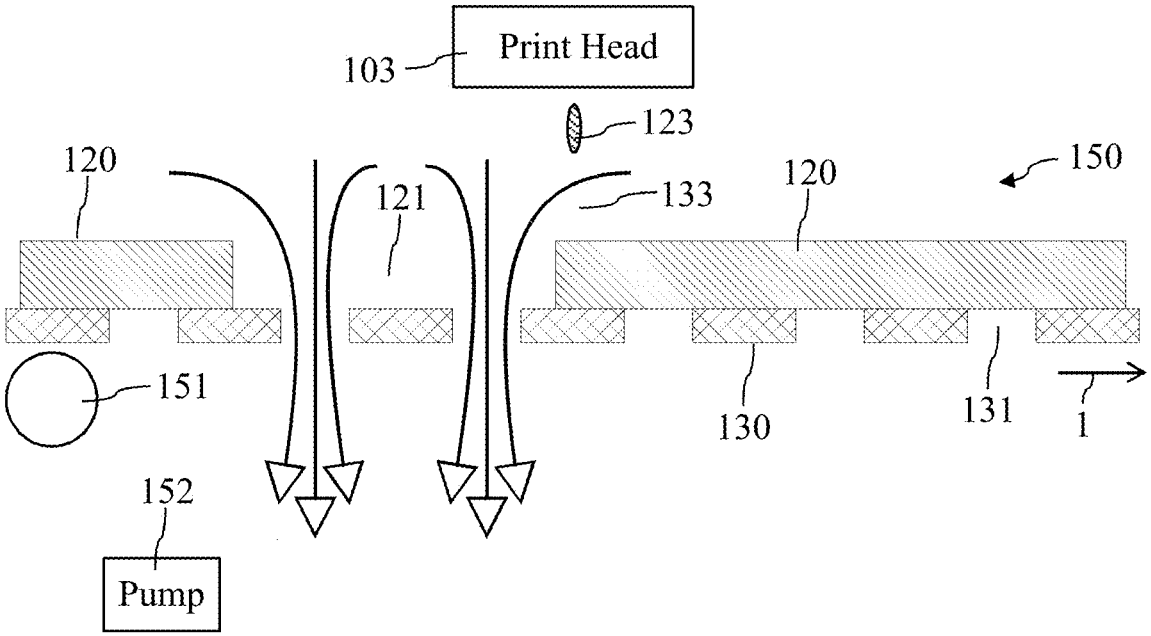

FIG. 1*b* illustrates a block diagram of a transporter for a recording medium according to an exemplary embodiment of the present disclosure.

FIGS. 2*a*-2*d* illustrate a transporter with an example decoupler, according to exemplary embodiments, in different operating states.

Figure 3A:
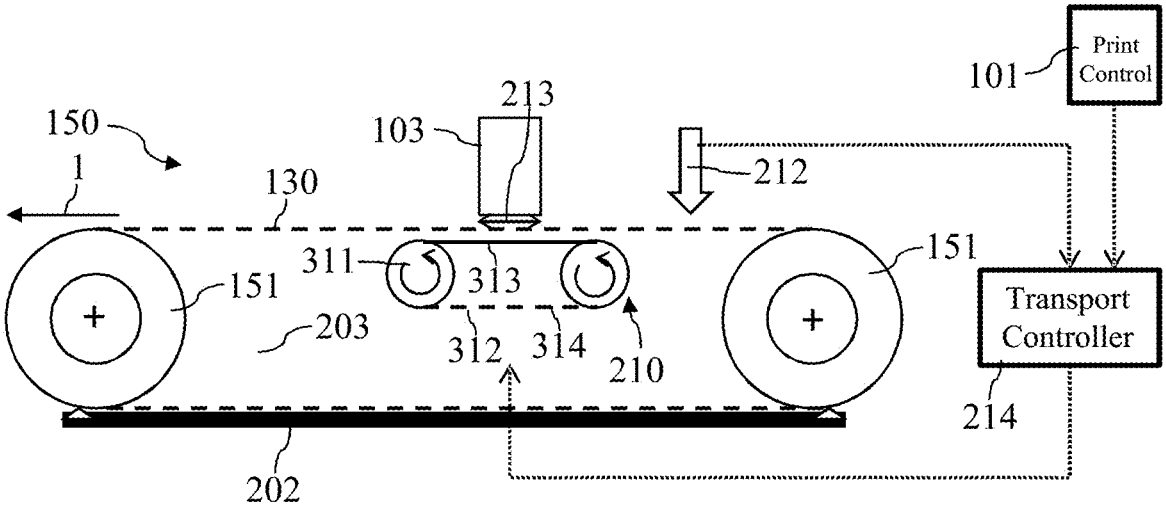
Figure 3B:
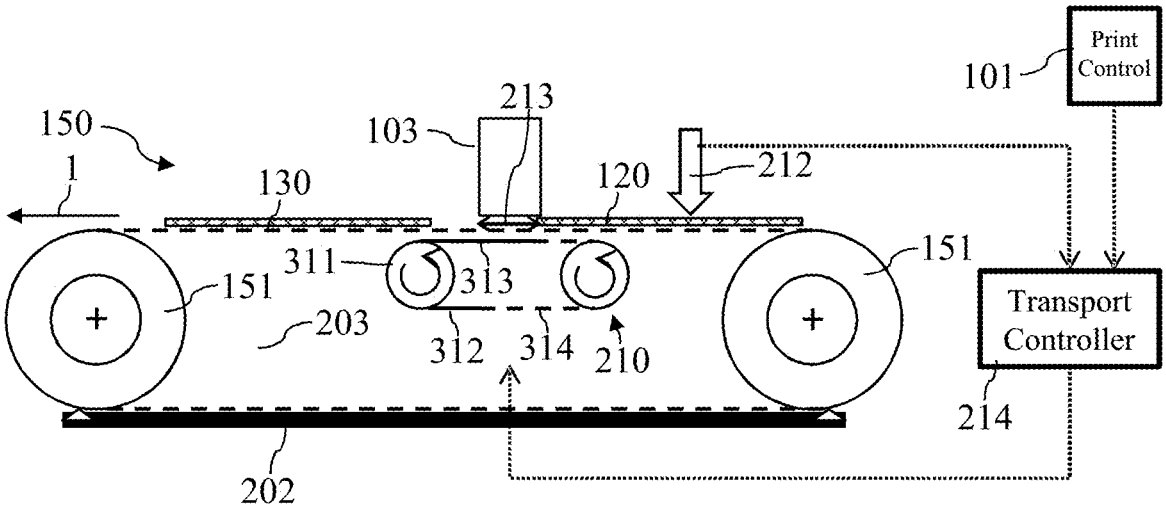
Figure 3C:
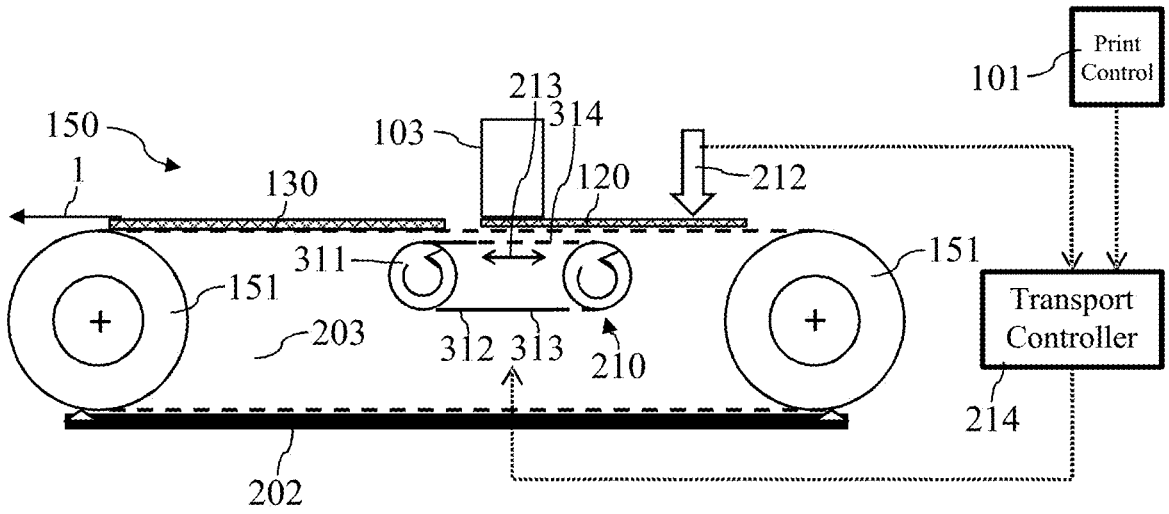

FIGS. 3*a*-3*c* illustrate a transporter with an additional example of a decoupler, according to exemplary embodiments, in different operating states.

Figure 4:
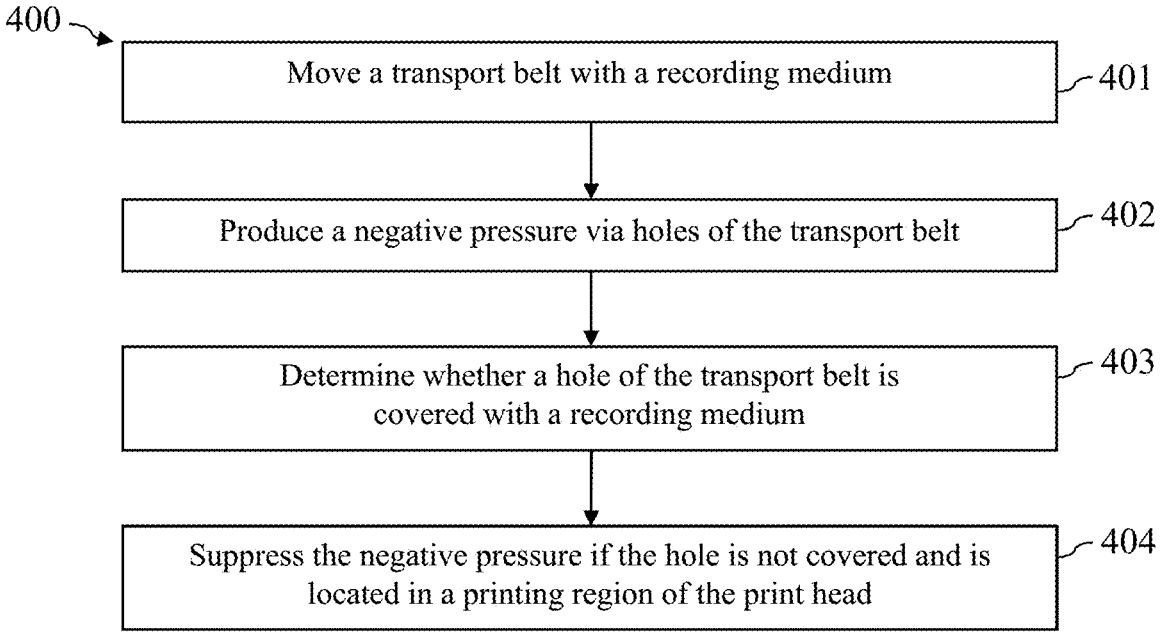

FIG. 4 illustrates a workflow diagram of a method for transporting a recording medium through a print group according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to increase the print quality of a printer upon printing to, and/or the efficiency of a transporter upon transport of, a recording medium in the form of a sheet or page or plate.

According to an exemplary embodiment of the disclosure, a transporter for transporting a recording medium through a print group of a printer is described, wherein the print group includes at least one print head. The transporter includes a transport belt and a transport belt support, wherein the transport belt support is configured to move the transport belt through the print group. The transport belt includes a plurality of holes and is configured to guide, in particular to carry, a recording medium on the top side of the transport belt through a region or printing region of the print head. The transporter moreover includes a negative pressure generator that is configured to produce a negative pressure via at least a portion of the plurality of holes of the transport belt, in order to draw a recording medium onto the top side of the transport belt.

In an exemplary embodiment, the transporter is configured to determine whether a first hole of the transport belt is covered or not by a recording medium arranged on the top side of the transport belt. The transporter is also configured to produce essentially no negative pressure through the first hole if it is determined that said first hole of the transport belt is not covered by a recording medium.

According to a further aspect of the disclosure, a method for transporting a recording medium through a print group of a printer is described, wherein the print group includes at least one print head. The method includes the movement of a transport belt through the print group, wherein the transport belt includes a plurality of holes, and wherein the transport belt is configured to guide a recording medium on the top side of said transport belt through the printing region of the print head. Moreover, the method includes the production of a negative pressure via at least a portion of the plurality of holes of the transport belt in order to draw a recording medium onto the top side of said transport belt. The method also includes the determination of whether a first hole of the transport belt is covered or not by the recording medium arranged on the top side of said transport belt. Furthermore, the method includes the suppression of the negative pressure through the first hole if it is determined that the first hole of the transport belt is not covered by a recording medium.

The printer 100 depicted in FIG. 1*a* is configured to print onto a recording medium 120 in the form of a sheet or page or plate. The recording medium 120 may be made of paper, paperboard, cardboard, metal, plastic, textiles, a combination thereof, and/or other materials that are suitable and can be printed to. The recording medium 120 is directed via a transport belt 130 along the transport direction 1 (represented by an arrow) through the print group 140 of the printer 100. Successive recording media 120 thereby typically have a defined distance from one another.

In the depicted example, the print group 140 of the printer 100 includes two print bars 102, wherein each print bar 102 may be used for printing with ink of a defined color (for example black, cyan, magenta, and/or yellow, and possibly MICR ink). Furthermore, the print group 140 may include at least one fixer 170 that is configured to fix a print image printed onto the recording medium 120.

A print bar 102 may include one or more print heads 103 that are possibly arranged in multiple rows side by side in order to print the dots of different columns 31, 32 of a print image onto the recording medium 120. In the example depicted in FIG. 1*a*, a print bar 102 includes five print heads 103, wherein each print head 103 prints the dots of a group of columns 31, 32 of a print image onto the recording medium 120.

In the embodiment depicted in FIG. 1*a*, each print head 103 of the print group 140 includes a plurality of nozzles 21, 22, wherein each nozzle 21, 22 is configured to fire or eject ink droplets onto the recording medium 120. A print head 103 of the print group 140 may include multiple thousands of effectively used nozzles 21, 22 that are arranged along multiple rows transversal to the transport direction 1 of the recording medium 120. Using the nozzles 21, 22 of a print head 103 of the print group 140, dots of a line of a print image may be printed onto the recording medium 120 transversal to the transport direction 1, meaning along the width of the recording medium 120.

The printer 100 also includes a controller 101 (for example an activation hardware and/or a processor) that is configured to activate the actuators of the individual nozzles 21, 22 of the individual print heads 103 of the print group 140 in order to apply the print image onto the recording medium 120 depending on print data. The controller 101 may be referred to as the print controller 101 while the controller 214 (discussed below) may be referred to as the transport controller 214. In an exemplary embodiment, the controller 101 includes processor circuitry that is configured to perform one or more functions/operations of the controller 101, including, for example, activating the actuators and/or controlling the overall operation of the printer 100.

The print group 140 of the printer 100 thus includes at least one print bar 102 having K nozzles 21, 22 that may be activated with a defined line clock pulse in order to print a line (transversal to the transport direction 1 of the recording medium 120) with K pixels or K columns 31, 32 of a print image onto the recording medium 120 (K>1000, for example) In the shown example, the nozzles 21, 22 are installed immobile or fixed in the printer 100, and the recording medium 120 is directed past the stationary nozzles 21, 22 with a defined transport velocity.

In a printer 100, recording media 120 in the form of sheets or pages or plates may be moved with the aid of a transport belt 130. FIG. 1*b* shows an example of a transporter 150 for such a recording medium 120. The transporter 150 has a transport belt support 151 (for example one or more drive wheels or drive rollers) via which the transport belt 130 may be moved. The transport belt 130 is thereby typically designed as a continuous belt. The transport belt 130 has a plurality of holes (or gaps) 131. A negative pressure is produced on an underside (or back side) of the transport belt 130 by a negative pressure generator (e.g. a negative pressure pump) 152, which negative pressure draws a recording medium 120 situated on the transport belt 130 onto said transport belt 130 via the holes 131 so that the recording medium 120 adheres to the transport belt 130 and may be transported. In order to achieve sufficiently high forces, the transport belt 130 may have holes 131 with relatively large cross sections or diameters and/or a relatively high number of holes 131 (for example multiple thousands of holes 131). The holes 131 in a transport belt 130 typically have a diameter of 5 mm to 10 mm. The negative pressure is typically at 10 mbar to 25 mbar, and is typically dependent on the recording medium 120 to be transported (for example on a thickness and/or a weight of the recording medium 120).

As long as recording media 120 follow directly, edge to edge, without a gap 121, the fluid consumption (in particular the air consumption) of a transporter 150 is relatively low because the recording media 120 cover and therefore seal the holes 131 of the transport belt 130. However, it is typically advantageous or necessary to maintain a defined distance 121 between recording media 120 in direct succession (for example in order to synchronize or time a processing procedure). The distance 121 between recording media 120 in direct succession may, if applicable, thereby be constant and known (given what is known as a "constant gap" printing). On the other hand, the distance 121 between recording media 120 in direct succession may vary (for example due to a subsequent processing procedure that has a defined "constant cycle").

Due to the distance 121 between different recording media 120, gaps on the transport belt 130 appear in which the holes 131 of the transport belt 130 are no longer covered, and thus a fluid flow (in particular an air flow) 133 through the uncovered holes 131 is produced in the direction of the negative pressure generator 152.

The produced fluid flow 133 may have a relatively high flow rate along the printing direction (meaning along the transporter 1), whereby the positioning accuracy of a print group 140 may be reduced (in particular given an inkjet printer 100, due to deflection of the ejected ink droplets 123) (as illustrated in FIG. 1*b*). Furthermore, the fluid flow 133 leads to an increased fluid consumption, and therefore to increased requirements for, and to an increased power consumption of, the negative pressure generator 152 of a transporter 150. The fluid flow 133 may also lead to a drying out of nozzles 21, 22 of a print head 103.

Figure 2A:
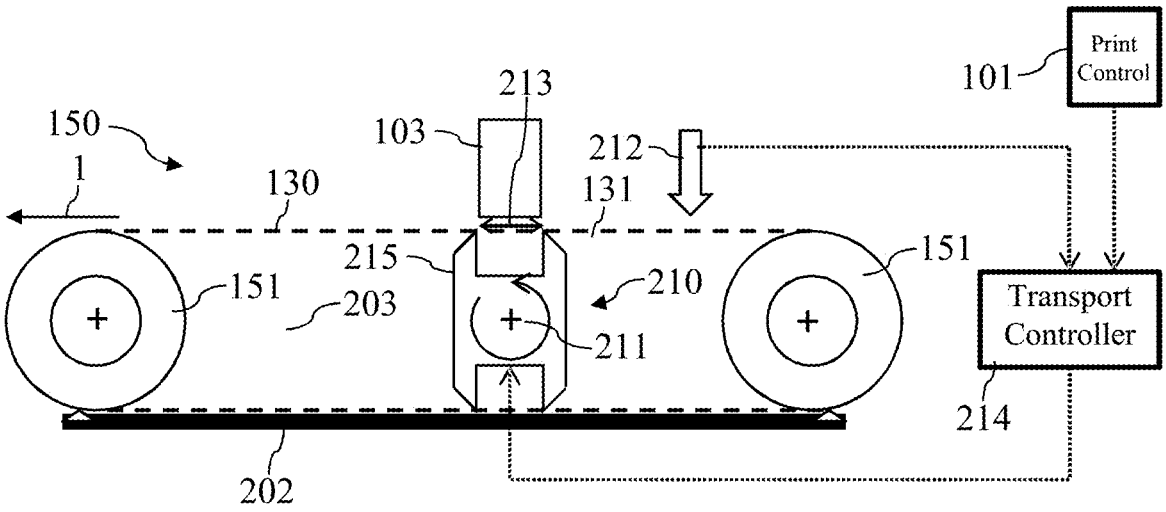

FIG. 2*a* shows a transporter 150 with a transport belt 130 that has a plurality of holes 131. The transporter 150 includes a decoupler 210 that is configured to cover one or more holes 131 in the transport belt 130, and thus to shield against the negative pressure or the negative pressure region 203. In particular, the decoupler 210 is configured to cover one or more holes 131 of the transport belt 130 in a region 213 below a print head 103 in order to specifically prevent an air flow 133 below the print head 103, in particular when a gap between two recording media 120 is located below the print head 103. In this document, the region 213 below a print head 103 is also referred to as the printing region 213 of the print head 103.

In the example depicted in FIG. 2*a*, the decoupler 210 is a rotatable shutter 215 that, as depicted in FIG. 2*a*, may be moved into a closed position in which the shutter 215 separates or decouples the partial region of the transport belt 130, which partial region is arranged in the printing region 213 below the print head 103, from the negative pressure chamber 203, so that a decoupled region in which no negative pressure is present is created in the partial region of the transport belt 130.

Figure 2B:
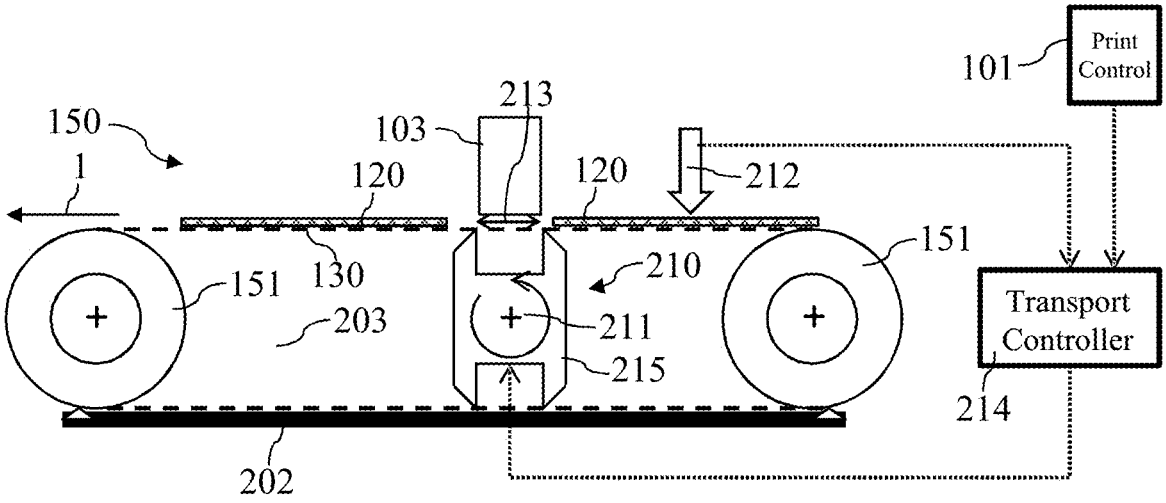

FIG. 2*b* shows the transporter 150 from FIG. 2*a* with two recording media in direct succession. Using a sheet sensor 212, it may be detected that a recording medium 120 on the transport belt 130 is moving toward the print head 130. The sheet sensor 212 may include an optical sensor (for instance an image camera), for example. On the basis of the sensor data of the sheet sensor 212, a controller 214 of the transporter 150 may determine when a recording medium 120 is driven into the printing region 213 (for example into the nip) below the print head 103. Depending on the sensor data of the sheet sensor 212, the decoupler 210 may be controlled such that the decoupler 210 seals off the partial region of the transport belt 130 below the print head 103 as long as no recording medium 120 is located on the transport belt 130 in this partial region. On the other hand, the decoupler 210 may at least partially open the partial region of the transport belt 130 below the print head 103 so that a negative pressure acts via at least a portion of the holes 131 in this partial region of the transport belt 130 if the sensor data of the sheet sensor 212 indicate that the partial region of the transport belt 130 in the printing region 213 below the print head 103 is at least partially covered by a recording medium 120.

Figure 2C:
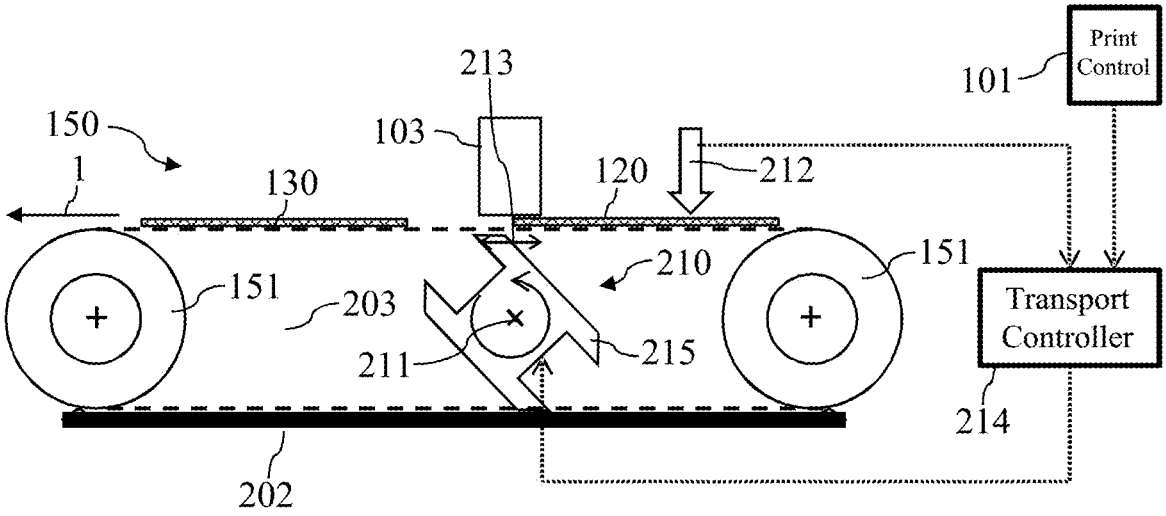
Figure 2D:
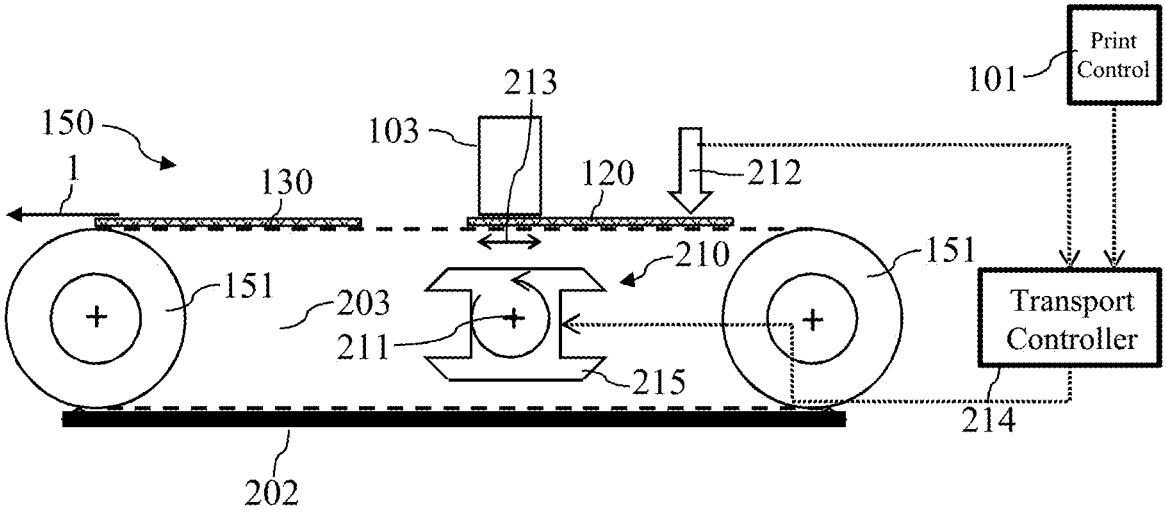

FIG. 2*c* illustrates how the decoupler 210 may be opened by rotating the shutter 215 about the axis 211 if the recording medium 120 enters into the printing region 213 below the print head 103. FIG. 2*d* illustrates the shutter 215 in a further rotated state. Opening the decoupler 210 may have the effect that the recording medium 120 is also reliably held on the transport belt 130 below the print head 103, and thus does not come into contact with the print head 103 (whereby the print head 103 might be damaged). Furthermore, a high print quality may be produced via the retention force/suction force on the recording medium 120 in order to hold the recording medium 120 on the transport belt 130. On the other hand, an air flow 133 below the print head 103, and the disadvantages that are linked therewith, may be avoided by closing the decoupler 210 (if no recording medium 120 is arranged in the printing region 213 of the print head 103).

A targeted active guidance of the vacuum or negative pressure in the region of the vacuum chamber 203 of the transport belt 130 may thus take place. Via a rotating shutter 215 synchronized with the sheet gaps, the partial region of the transport belt 130 that is arranged below the respective nip may be separated from the negative pressure below each print head row (meaning below each print bar 102) of a print group 140 as soon as a gap between two recording media 120 passes the respective nip.

FIGS. 3*a* through 3*c* show an additional example of a decoupler 210. The decoupler 210 thereby has a (continuous) cover belt 312 that has a first segment 313 with which the partial region of the transport belt 130 may be covered in the printing region 213 below the print head 103 in order to seal one or more holes 131 of the transport belt 130. Furthermore, the cover belt 312 has a second segment 314 via which the holes 131 of the transport belt 130 are essentially not sealed, so that the negative pressure may continue to act through the holes 131. The cover belt 312 may be moved by a transport belt support 311 (for example by two or more rollers).

In an exemplary embodiment, the controller 214 is configured to induce/control the decoupler 210 to position the first segment 313 below the transport belt 130, based on the sensor data of the sheet sensor 212, if the transport belt 130 is not covered by a recording medium 120. On the other hand, the second segment 314 may be positioned (e.g. bit by bit) below the transport belt 130 (for example, synchronously with the recording medium 120) if a recording medium 120 is moved into the printing region 213 below the print head 103. It may thus be precisely produced that, in the printing region 213 below the print head 103,

- a negative pressure is produced via a hole 131 of the transport belt 130 if the hole is covered by a recording medium 120; and
- production of a negative pressure is halted (e.g. no negative pressure is produced) via a hole 131 if the hole 131 is not covered by a recording medium 120.

A transporter 150 for transporting a recording medium 120 through a print group 140 of a printer 100 is thus described, wherein the print group 140 includes at least one print head 103. The transporter 150 has a transport belt 130 and a transport belt support 151, where the transport belt support 151 is configured to move the transport belt 130 through the print group 140. The transport belt 130 may be a continuous belt that is moved via driven rollers.

The transport belt 130 is configured to direct a recording medium 120 in the form of a sheet or page or plate, said recording medium 120 being on the top side (or the front side) of the transport belt 130, along a transport direction 1 through the printing region 213 of the print head 103. The printing region 213 of the print head 103 thereby corresponds to a defined segment of the print group 140 along the transport direction 1. The printing region 213 of the print head 103 is typically dependent on the spatial extent of the nozzle plate of the print head 103 along the transport direction 1. For example, the printing region 213 of the print head 103 may correspond to the region of the nozzle plate, possibly expanded by a border region in the transport direction 1 before the region of the nozzle plate and a border region in the transport direction 1 after the region of the nozzle plate. The border regions may have an extent in the transport direction 1 that corresponds to 10%, 20%, 50% or more of the extent of the nozzle plate in the transport direction 1, for example. The extent of the printing region 213, and in particular of the border regions, may on the one hand be chosen to be as small as possible in order to limit the selective suppression of negative pressure that is described in this document to an optimally small region (in order to enable low costs for a transporter 150). On the other hand, the extent of the printing region 213, and in particular of the border regions, may be large, such that essentially no negative effect on the nozzles 21, 22 and/or on the flight path of ink droplets 123 of the print head 103 is produced by an air flow 133 produced outside of the printing region 213 by a hole 131 of the transport belt 130.

The print group 140 may include a plurality of print heads 103 that are arranged one after another in the transport direction 1. In an exemplary embodiment, the transporter 150 is configured to direct a recording medium 120 through the printing regions 213 of the plurality of print heads 103.

The transport belt 130 includes a plurality of holes 131. The transporter 150 also includes a (possibly precisely one) negative pressure generator 152 that is configured to produce a negative pressure via at least a portion of the plurality of holes 131 of the transport belt 130 in order to draw the recording medium 120 onto the top side of the transport belt 130. A negative pressure may thereby be produced through holes 131 of the transport belt 130, which holes 131 face toward one or more print heads 103 of the print group 140 (and which may be covered by a recording medium 120). The holes 131 of the (continuous) transport belt 130 that face away from the one or more print heads 103 of the print group 140 may be covered or sealed by a sealing element 202 (for example, as depicted in FIGS. 2*a*-2*d* and 3*a*-3*c*).

In an exemplary embodiment, the transporter 150 is configured to determine whether a first hole 131 of the transport belt 130 is covered or not by a recording medium 120 arranged on the top side of the transport belt 130. If applicable, the movement of the transport belt 130 may be synchronized with the placement of recording media 120 in the form of sheets or pages or plates onto the transport belt. In this instance, whether a defined hole 131 of the transport belt 130 is covered or not may be determined on the basis of the timing of the placement of recording media 120 onto the transport belt. Such a synchronization is typically very complicated or not possible. For this reason, the transport direction 150 may include a sensor 212 that is configured to detect sensor data with regard to a recording medium 120 arranged on the top side of the transport belt 130. An image sensor, for instance a camera, and/or a photoelectric barrier may be used as a sensor 212, for example. A controller 214 of the transporter 150 may then determine, on the basis of the sensor data of the sensor 212, whether a defined hole 131 of the transport belt 130 is covered or not by the recording medium 120. The respectively considered hole 131 of the transport belt 130 is also referred to as the "first" hole 131 in this document. The first hole 131 may thereby be an arbitrary hole 131 of the transport belt 130. In particular, the first hole 131 may be a hole 131 of the transport belt 130 that is located below a print head 103 at a defined point in time.

For example, an edge, in particular a leading edge and/or a trailing edge, of a recording medium 120 may be detected on the basis of the sensor data of the sensor 212. The distance between recording media 120 in direct succession may then be detected based thereupon. Furthermore, the positioning of the gaps or of the clearance between two recording media 120 may be determined relative to a print head 103.

In an exemplary embodiment, the transporter 150 is configured to produce essentially no negative pressure through the first hole 131 if it is determined that the first hole 131 of the transport belt 130 is not covered by a recording medium 120 (and thus is located in a gap or a clearance between two successive recording media 120). On the other hand, the negative pressure through the first hole 131 may be produced if it is determined that the first hole 131 of the transport belt 130 is covered by a recording medium 120. A hole-selective provisioning of negative pressure through the holes 131 of the transport belt 130 may thus take place depending on whether a hole is covered or not by a recording medium 120. The air consumption of the transporter 150 may thus be reduced. Furthermore, it may thus be prevented that the nozzles 21, 22 of the print head 103 of a printer 100 are negatively affected by air currents 133 through uncovered holes 131.

In an exemplary embodiment, the transporter 150 is configured to produce essentially no negative pressure through the first hole 131 (only) when the first hole 131 of the transport belt 130 is arranged in the printing region 213 of a print head 103 of the print group 140. In other words, the suppression of the negative pressure through one or more uncovered holes 131 of the transport belt 130 may be limited to the printing regions 213 of the one or more print heads 103 of the print group 140. The costs for the selective suppression of negative pressure may thus be limited while a negative effect on the nozzles 21, 22 of the one or more print heads 103 continues to be avoided.

In an exemplary embodiment, the transporter 150 is configured to seal the first hole 131, cover the first hole 131, and/or decouple the first hole 131 from the negative pressure generator 152 so that essentially no negative pressure is produced by the first hole 131. In particular, the transport direction 150 may include a decoupler 210 that is configured to cover, seal, and/or decouple from the negative pressure generator 152 one or more holes 131 of the transport belt 130, from the underside of the transport belt 130, in particular one or more holes 131 of the transport belt 130 that are moved in the printing region 213 of a print head 103. The negative pressure may thus be efficiently and reliably suppressed in a hole-selective and/or region-selective manner (if applicable given use of a single negative pressure generator 152).

In an exemplary embodiment, the decoupler 210 is configured to cover, seal, and/or decouple from the negative pressure generator 152, in a spatially delimited manner, the one or more holes 131 of the transport belt 130 that are located in the printing region 213 of a print head 103. On the other hand, if applicable no covering, sealing, and/or decoupling of the holes 131 of the transport belt 131 may take place in the regions outside of the printing regions 213 of the one or more print heads 103. The negative effect on the nozzles 21, 22 of the print head 103 may be cost-effectively avoided via the provisioning of a decoupler 210 that is limited to the printing region 213 of a print head 103.

In an exemplary embodiment, the decoupler 210 includes a decoupling part 215 (for example in the form of a shutter) that is borne so as to be able to rotate. In an exemplary embodiment, the decoupling part (also referred to as a covering) 215 is configured to, in a first rotation position, cover, seal, and/or decouple from the negative pressure generator 152 one or more holes 131 of the transport belt 130 (in particular the holes 131 that correspond to a clearance between two successive recording media 120). In an exemplary embodiment, the decoupling part 215 is configured to, in a second rotation position, couple the one or more holes 131 of the transport belt 130 with the negative pressure generator 152.

In an exemplary embodiment, the transporter 150 is configured to transfer the decoupling part 215 alternately and repeatedly into the first and second rotation position via rotation in a (single) direction using an electrical motor. The holes 131 arranged in the printing region 213 of a print head 103 may thus be efficiently, selectively covered, sealed, and/or decoupled from the negative pressure generator 152 or from the negative pressure (in the first rotation position) if the holes 131 are not covered with a recording medium 120, and are charged with a negative pressure (in the second rotation position) if the holes 131 are covered with a recording medium 120. A recording medium 120 in the form of a sheet or page or plate may thus be guided through the printing region 213 of the print head 103 reliably, and without negatively affecting the nozzles 21, 22 of a print head 103.

In an exemplary embodiment, the decoupler 210 includes a cover belt (also referred to as a cover) 312, in particular designed as a continuous belt, that has a first (air-impermeable) segment 313 via which one or more holes 131 of the transport belt 130 are covered from the underside of the transport belt 130, and a second (air-permeable) segment 314 via which the one or more holes 131 of the transport belt 130 are not covered. The decoupler 210 may be designed to move the cover belt 312 along the transport direction 1 in order to alternately and repeatedly direct the first segment 313 and the second segment 314 to the underside of the transport belt 130. The first segment 313 may thereby be directed to the underside of the transport belt 131 if no recording medium 120 is located in the printing region 213 of a print head 103, at least per region. On the other hand, the second segment 314 may be directed to the underside of the transport belt 131 if a recording medium 120 is located in the printing region 213 of a print head 103, at least per region. A hole-selective suppression of negative pressure within the printing region 213 of a print head 103 may thus be produced in a particularly efficient and precise manner.

In an exemplary embodiment, the controller 214 is configured to determine whether a recording medium 120 is or is not located, at least per region, in the printing region 213 of the print head 103 (for example, based on the sensor data of the sensor 212). The decoupler 210 may be induced to cover, seal, and/or decouple from the negative pressure generator 152 the one or more holes 131 of the transport belt 130 that are arranged in the printing region 213 of the print head 103, if it is determined that no recording medium 120 is located at least per region in the printing region 213 of the print head 103. On the other hand, the decoupler 210 may be induced to couple with the negative pressure generator 152 the one or more holes 131 of the transport belt 130 that are arranged in the printing region 213 of the print head 103, if it is determined that a recording medium 120 is located in at least one part of the printing region 213 of the print head 103.

In an exemplary embodiment, the decoupler 210 is configured to couple holes 131 of the transport belt 130 with the negative pressure generator 152 bit by bit along the transport direction 1 of the transport belt 130 (for example in that the second segment 314 of the aforementioned cover belt 312 is moved to the underside of the transport belt 130), and/or to cover, seal, and/or decouple from the negative pressure generator 152 holes 131 of the transport belt 130 (for example in that the first segment 313 of the aforementioned cover belt 312 is moved to the underside of the transport belt 130).

In an exemplary embodiment, the controller 214 is configured to activate the decoupler 210 synchronously with the movement of the transport belt 130 so that, upon arrival of a recording medium 120 in the printing region 213 of the print head 103, the one or more holes 131 of the transport belt 130 that are located within the printing region 213 of the print head 103 and are covered by the recording medium 120 are coupled bit by bit with the negative pressure generator 152. On the other hand, upon the departure of a recording medium 120 from the printing region 213 of the print head 103, the one or more holes 131 of the transport belt 130 that are located within the printing region 213 of the print head 103 but are not covered by the recording medium 120 are covered, sealed, and/or decoupled from the negative pressure generator 152 bit by bit. The one or more holes 131 may then remain covered, sealed, and/or decoupled from the negative pressure generator 152 until the arrival of a subsequent recording medium 120.

The negative effect on the nozzles 21, 22 of the print head 103 may be particularly reliably avoided via a hole-selective provisioning and suppression of negative pressure within the printing region 213 of a print head 103.

In an exemplary embodiment, the transporter 150 is configured to transport a recording medium 120 on a transport belt 130 through a print group 140 having at least one print head 103. The transport belt 130 has a plurality of holes 131 via which a negative pressure may be produced in order to draw a recording medium 120 onto the transport belt 130. In order to avoid an air flow 133 below the print head 103, the transporter 150 is configured such that no negative pressure is selectively produced through holes 131 that are located below the print head 103 and that are not covered by a recording medium 120.

In particular, for this purpose holes 131 of the transport belt 130 that are located below a print head 103 or a print bar 102 and that are not covered by a recording medium 120 are covered (from the underside of the transport belt 130). This may be produced via the covers 215 (shutter), 312 (cover belt) described in this document. A clearance or a gap between two successive recording media 120 may be detected by the sensor data of a sensor 212. A cover 215, 312 may then be synchronized with the clearance between the two successive recording media 120 in order to selectively cover uncovered holes 131 of the transport belt 130 if the holes 131 are located below a print head 103 or a print bar 102. On the other hand, holes 131 of the transport belt 130 that are covered by a recording medium 120 may be uncovered by the cover 215, 312 (in order to hold the recording medium 120 on the transport belt 130).

In an exemplary embodiment, the cover 215, 312 is configured to be movable, and the movement of the cover 215, 312 may be synchronized with the transport of the recording medium 120. Furthermore, the cover 215, 312 may be arranged within or below the transport belt 130 and below a print head 103 or print bar 102. In particular, the area of effect of the cover 215, 312 may be limited to the region 213 below a print head 103 or print bar 102.

An aspect of the disclosure includes a printer 100 that includes the transporter 150.

FIG. 4 shows a workflow diagram of a method 400 for transporting a recording medium 120 through a print group 140 of a printer 100 according to an exemplary embodiment. In an aspect, the print group 140 includes at least one print head 103. In an exemplary embodiment, the method 400 includes the movement 401 of a transport belt 130 through the print group 140, where the transport belt 130 includes a plurality of holes 131, and wherein the transport belt 130 is configured to guide a recording medium 120 on the top side of the transport belt 130 through the printing region 213 of the print head 103. Moreover, the method 400 includes the production of a negative pressure through at least a portion of the plurality of holes 131 of the transport belt 130 in order to draw a recording medium 120 onto the top side of the transport belt 130. The method 400 also includes the determination 403 of whether a first hole 131 of the transport belt 130 is covered or not by the recording medium 120 arranged on the top side of the transport belt 130. Furthermore, the method 400 includes the suppression 404 of the negative pressure through the first hole 131 if it is determined that the first hole 131 of the transport belt 130 is not covered by a recording medium 120.

Via the measures described in this document, it may be produced that that print heads 103 of a printer 100 are not negatively affected by the transport of recording media 120 in the form of sheets or pages or plates. This applies in particular at a start or end of printing (if no recording medium 120 is transported for a longer period of time). Furthermore, the use of higher negative pressures for an improved transport is enabled via the described measures. Moreover, the print quality of a printer 100 may be increased via the described measures.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, a programmable processing circuit, other structural electronic hardware, or a combination thereof. A processor includes a microprocessor, a digital signal processor (DSP), central processor (CPU), application-specific instruction set processor (ASIP), graphics and/or image processor, multicore processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
21, 22 nozzle
31, 32 column (of the print image)
100 printer
101 controller
102 print bar
103 print head
120 recording medium
121 distance (between recording media)
123 ink droplets
130 transport belt
131 hole (transport belt)
140 print group
150 transporter
151 transport belt support
152 negative pressure generator
170 fixer
202 sealing element
203 negative pressure chamber
210 decoupler
211 axis
215 decoupling part (shutter)
212 sheet sensor
213 printing region
214 controller
311 transport belt support (decoupler)
312 cover belt
313, 314 segments (cover belt)
400 method for transporting a recording medium
401-404 method steps

The invention claimed is:

1. A printer, comprising:

a print group including at least one print head; and a transporter configured to transport one or more recording mediums through the print group, the transporter including:

a continuous transport belt including a plurality of holes, and a transport belt support configured to move, through a region of the at least one print head, successive recording mediums of the one or more recording mediums, having a defined distance relative to one another, on a top side of the transport belt;

a negative pressure generator that is configured to produce, via at least a portion of the plurality of holes of the transport belt, a negative pressure to hold a recording medium of the one or more recording mediums on the top side of the transport belt;

a decoupler configured to selectively cover, seal, and/or decouple from the negative pressure generator, in a spatially delimited manner, from an underside of the transport belt, one or more of the plurality of holes of the transport belt that are moved into the region of the at least one print head; and a controller configured to:

determine whether the recording medium of the one or more recording mediums is located in the region of the at least one print head, or whether a gap between two successive recording mediums of the one or more recording mediums is located in the region of the at least one print head;

induce the decoupler to cover, seal, and/or decouple from the negative pressure generator, in a spatially delimited manner, the one or more of the plurality of holes of the transport belt that are arranged in the region of the at least one print head if it is determined that the gap between two successive recording mediums of the one or more recording mediums is located in the region of the at least one print head; and induce the decoupler to couple, with the negative pressure generator, the one or more of the plurality of holes of the transport belt that are arranged in the region of the at least one print head if it is determined that the recording medium of the one or more recording mediums is located at least in a portion of the region of the at least one print head.

2. The printer according to claim 1, wherein:

the decoupler comprises a decoupling part that is rotatable;

in a first rotation position, the decoupling part is configured to cover, seal, and/or decouple from the negative pressure generator the one or more of the plurality of holes of the transport belt;

in a second rotation position, the decoupling part is configured to couple the one or more of the plurality of holes of the transport belt with the negative pressure generator; and the transporter is configured to alternately and repeatedly transition the decoupling part into the first rotation position and the second rotation position via rotation in one direction.

3. The printer according to claim 2, wherein the decoupling part is a rotatable shutter.

4. The printer according to claim 1, wherein:

the decoupler comprises a cover belt configured as a continuous belt, the cover belt having a first segment via which the one or more of the plurality of holes of the transport belt are covered from the underside of the transport belt, and a second segment via which the one or more of the plurality of holes of the transport belt are uncovered; and the decoupler is configured to move the cover belt along a transport direction to alternately and repeatedly direct the first segment and the second segment to the underside of the transport belt.

5. The printer according to claim 4, wherein the decoupler is configured to synchronously move the cover belt, along the transport direction, with gaps between two respective successive recording mediums of the one or more recording mediums to alternately and repeatedly direct the first segment and the second segment to the underside of the transport belt.

6. The printer according to claim 1, wherein:

the decoupler is configured to couple, bit by bit along a transport direction of the transport belt, the one or more of the plurality of holes of the transport belt with the negative pressure generator, and/or to cover, seal, and/or decouple the one or more of the plurality of holes of the transport belt from the negative pressure generator; and the controller is configured to activate the decoupler synchronously with a movement of the transport belt to:

upon arrival of a recording medium of the one or more recording mediums in the region of the at least one print head, couple, bit by bit, the one or more of the plurality of holes of the transport belt that are located within the region of the at least one print head and are covered by the recording medium with the negative pressure generator; and upon departure of a recording medium from the region of the at least one print head, to, bit by bit, cover, seal, and/or decouple the one or more of the plurality of holes of the transport belt, which are located within the region of the at least one print head but that are not covered by the recording medium, from the negative pressure generator.

7. The printer according to claim 1, wherein:

the transporter further comprises a sensor configured to detect a recording medium of the one or more recording mediums arranged on the top side of the transport belt, and to generate sensor data corresponding to the detection; and the controller is further configured to determine, based on the sensor data, a position of the recording medium with respect to the region of the at least one print head.

8. The printer according to claim 1, wherein the negative pressure generator is a negative pressure pump.

9. The printer according to claim 1, wherein the transport belt support comprises one or more drive wheels and/or one or more drive rollers.

10. A transport system to transport one or more recording mediums through a print group including at least one print head, the transporter comprising:

a continuous transport belt including a plurality of holes, and a transport belt support configured to move, through a region of the at least one print head, successive recording mediums of the one or more recording mediums, having a defined distance relative to one another, on a top side of the transport belt;

a negative pressure generator that is configured to produce, via at least a portion of the plurality of holes of the transport belt, a negative pressure to hold a recording medium of the one or more recording mediums on the top side of the transport belt;

a decoupler configured to selectively cover, seal, and/or decouple from the negative pressure generator, in a spatially delimited manner, from an underside of the transport belt, one or more of the plurality of holes of the transport belt that are moved into the region of the at least one print head; and a controller configured to:

determine whether the recording medium of the one or more recording mediums is located in the region of the at least one print head; and control the decoupler to selectively cover, seal, and/or decouple from the negative pressure generator the one or more of the plurality of holes of the transport belt that are arranged in the region of the at least one print head from the negative pressure generator based on the determination.

11. The transport system according to claim 10, wherein controlling the decoupler comprises:

inducing the decoupler to cover, seal, and/or decouple from the negative pressure generator, in a spatially delimited manner, the one or more of the plurality of holes of the transport belt that are arranged in the region of the at least one print head if it is determined that the gap between two successive recording mediums of the one or more recording mediums is located in the region of the at least one print head; and induce the decoupler to couple, with the negative pressure generator, the one or more of the plurality of holes of the transport belt that are arranged in the region of the at least one print head if it is determined that the recording medium of the one or more recording mediums is located at least in a portion of the region of the at least one print head.

12. A printer, comprising:

the transport system as claimed in claim 10; and the print group.

13. A method for transporting one or more recording mediums through a print group of a printer, the print group including at least one print head, the method comprising:

moving a transport belt through the print group, the transport belt including a plurality of holes, and is configured to move successive recording mediums of the one or more recording mediums, having a defined distance relative to one another, through a region of the print head on a top side of the transport belt;

producing, by a negative pressure generator, a negative pressure via at least a portion of the plurality of holes of the transport belt to draw or hold a recording medium of the one or more recording mediums onto the top side of the transport belt;

determining whether the recording medium of the one or more recording mediums is located in the region of the print head, or whether a gap between two successive recording mediums of the one or more recording mediums is located in the region of the print head;

inducing a decoupler to cover, seal, and/or decouple from the negative pressure generator, in a spatially delimited manner, one or more of the plurality of holes of the transport belt that are arranged in the region of the print head if it is determined that the gap between two successive recording mediums of the one or more recording mediums is located in the region of the print head; and inducing the decoupler to couple with the negative pressure generator the one or more of the plurality of holes of the transport belt that are arranged in the region of the print head if it is determined that the recording medium of the one or more recording mediums is located at least in a portion of the region of the print head.

14. A non-transitory computer-readable storage medium with an executable program stored thereon, wherein, when executed, the program instructs a processor to perform the method of claim 13.

* * * * *